US006918341B1

(12) United States Patent
Welsch et al.

(10) Patent No.: US 6,918,341 B1
(45) Date of Patent: Jul. 19, 2005

(54) SUPPORT FOR SECURING CANTILEVERED SHELVING TO AN INSULATED UNIT

(75) Inventors: John H. Welsch, Moscow, PA (US); Robert Welch, Dallas, PA (US); Willard J. Sickles, Dalton, PA (US); James D. Hill, Effort, PA (US)

(73) Assignee: Metro Industries, Inc., Reno, NV (US)

( * ) Notice: Subject to any disclaimer, the term of this patent is extended or adjusted under 35 U.S.C. 154(b) by 228 days.

(21) Appl. No.: 10/054,704

(22) Filed: Jan. 24, 2002

(51) Int. Cl.[7] ..... A47B 47/00
(52) U.S. Cl. ..... 108/180; 108/64
(58) Field of Search ..... 108/180, 185, 108/64, 65, 153.1; 248/245; 220/592.1, 592.01, 592.02, 592.09; 312/400, 406, 409

(56) References Cited

U.S. PATENT DOCUMENTS 2,296,782 A * 9/1942 Fischer et al. ..... 108/64
3,994,242 A * 11/1976 Damberg ..... 108/64
4,105,351 A * 8/1978 Anderson ..... 108/64
4,296,524 A * 10/1981 Horholt et al. ..... 108/64
4,409,906 A * 10/1983 Alneng ..... 108/64
4,503,781 A * 3/1985 Nilsson ..... 108/64
4,915,034 A * 4/1990 Grabe et al. ..... 108/65
5,645,257 A * 7/1997 Ward ..... 248/245
5,671,991 A * 9/1997 Grant ..... 312/406
5,941,622 A * 8/1999 Davidson et al. ..... 312/400
6,085,668 A * 7/2000 Kanki ..... 108/65
6,350,002 B1 * 2/2002 Takaoka et al. ..... 312/400
6,485,122 B2 * 11/2002 Wolf et al. ..... 312/400
6,485,219 B1 * 11/2002 Beyer et al. ..... 403/338

* cited by examiner

*Primary Examiner*—Jose V. Chen
(74) *Attorney, Agent, or Firm*—Fitzpatrick, Cella, Harper & Scinto

(57) ABSTRACT

A support adapted for use between first and second panels at a joint includes a distal end including a flange, an anchoring end including a flange and an anchor, and an intermediate section connecting the distal end and the anchoring end. The intermediate section is shaped to mate with adjoining edges of the first and second panels.

26 Claims, 6 Drawing Sheets

SUPPORT FOR SECURING CANTILEVERED SHELVING TO AN INSULATED UNIT

FIELD OF THE INVENTION

The present invention relates to a support for securing shelving, particularly cantilevered shelving, to an insulated unit without compromising the insulating properties of the unit.

BACKGROUND OF THE INVENTION

Insulated units, such as walk-in coolers or freezers, are typically box-like structures of sufficient size to allow an individual to walk around in the unit while standing up. The insulated unit, hereafter referred to as a "walk-in," may be provided with a refrigeration system, or perhaps in certain applications a heating system, and is used for storing items at either low or high temperatures relative to the outside environment. For example, a walk-in may be used in grocery stores, convenience stores, bars or restaurants to store food products such as meat, cheese, beer, and a variety of other foods that are not immediately needed. Application may also be found in other industries, such as pharmaceutical laboratories.

To maximize the use of storage space within the walk-in, interior shelving is typically provided. This shelving may be free-standing or cantilevered. Examples of free-standing shelving are described in U.S. Pat. No. 3,424,111 to Maslow; U.S. Pat. No. 3,874,511 to Maslow; U.S. Pat. No. 4,811,670 to Kolvites; et al. and U.S. Pat. No. 6,017,009 to Swartz, et al.

However, cantilevered shelving, such as that shown in U.S. Pat. No. 5,645,257 to Ward, has the advantage of not having front vertical support posts that can hamper access to items on the shelves. Nevertheless, there are significant problems encountered in mounting cantilevered shelves in a walk-in. For example, because of the manner in which walk-ins are constructed, prior art systems that are strong enough to support shelving and the items on them tend to compromise the insulating properties of the walk-ins.

For purposes of explanation, the construction of a conventional walk-in cooler is described below with reference to the accompanying drawings.

As shown in the perspective view of FIG. 9, the walk-in 300 is typically constructed of a plurality of interlocking wall panels 100 and ceiling panels 200.

As shown in the partial plan and partial elevational views, which are respectively FIGS. 7 and 8, a conventional wall panel 100 comprises a core 102 of insulation, preferably polyurethane foam. An inner skin 104 and an outer skin 106, also called inner and outer sidewalls, are disposed on opposite sides of the core 102 and are preferably made of thin sheetmetal. The side edges 108, 110 of the wall panels are preferably not covered by sheetmetal except for a small marginal lip 107 formed where the sheetmetal skins 104, 106 have been folded inwardly at right angles. An elastomeric seal 109, made for example of rubber or plastic, is preferably provided on each lip 107 at adjoining edges of the panels to provide a seal between panels when they are assembled as described below. This seal minimizes migration of moisture through the walk-in and into the insulating core. In addition, the edges 108, 110 are preferably contoured so that one wall panel 100 can easily mate with an adjacent wall panel 101. A male-female C- or U-shaped contour is illustrated in FIG. 7, but a variety of contours, and even a straight profile, are possible.

Ceiling panels 200 are formed from the same components as the wall panels 100. As shown in FIG. 9, however, the assembly of the ceiling panels 200 differs in that the inner skin 204 does not extend all of the way to the side edges 208. Rather, the core 202 is exposed in a region near each edge 208. In this way, the ceiling panel 200 can mate with a top edge 110*a* of each wall panel 100 as shown in FIG. 9.

As will be appreciated, each wall panel 100 is formed to include one edge 108 having a female contour and one edge 110 having a male contour. In addition, each panel has an interlocking mechanism on the side of the male-contoured edge 110 to be secured at the female contour of an adjacent panel. The same principle of interchangeability also applies to ceiling panels 200. Of course, one of ordinary skill will understand that some panels, such as panels that make up corners or the front and back panels of the ceiling, will differ slightly from the wall and ceiling panels 100, 200 described above.

To form a wall, one wall panel 100 is interlocked with another wall panel 101 so that their edges 108, 110 mate, forming a joint. The wall panels house a plurality of interlocking mechanisms at a number of locations 116 along each edge 108, 110, as shown in FIG. 9. The interlocking mechanism typically comprises a suitable pawl 112 and cam-tightening means (not shown) in one panel and a catch (not shown) in the mating panel. The catch is preferably a metal rod embedded in any suitable fashion in the core 102. The pawl 112 engages the catch and interlocks the wall panels 100, 101 when a user rotates the cam-tightening means by way of a removable allen wrench 114. The ceiling panels 200 are interlocked together and are interlocked with the side panels in substantially the same manner.

In order to construct cantilevered shelving without compromising the insulating properties of the walk-in, a fastener would ideally engage only the inner skin 104 of a wall panel 100. However, the inner skin 104, being thin sheetmetal, is incapable of supporting substantial load applied by the shelving and the items placed on it. If the shelving is attached to the sheetmetal with such a fastener, when the shelving is loaded the sheetmetal may bend or the fastener may pull through it. As a result, conventional cantilevered shelving is normally attached to the walls with long bolts that pass through the inner skin 104, the core 102 and the outer skin 106. On the outside of the walk-in 300, a stress plate is generally used at each bolt to distribute the load over a large area to prevent pull-through. These bolts, however, serve as paths for heat transfer and can also allow humidity to enter into the walk-in, thus reducing its insulating properties.

Accordingly, there is a need in the art for a support that is strong enough to support loaded shelving, but which does not compromise the insulating properties of the walk-in.

SUMMARY OF THE INVENTION

According to one aspect of the invention, a support is adapted for use between first and second panels at a joint. The support comprises a distal end, that may include a flange, an anchoring end, that also may include a flange, and an anchor, and an intermediate section connecting the distal end and the anchoring end. The intermediate section is shaped to be congruent to and mate with adjoining edges of the first and second panels.

In another aspect of the invention, the anchoring end is formed or otherwise adapted to support at least one shelf directly or through one or more intermediate elements.

In yet another aspect of the invention, the intermediate section includes an aperture for allowing the pawl, comprising the interlocking mechanism in the first panel, to pass through the support.

In still another aspect of the invention, an apparatus comprises a first panel having an inner and an outer wall, a second panel having an inner and an outer wall and joined to the first panel at a joint, and a support secured between the first and second panels at the joint. The support includes a distal end, an anchoring end, and an intermediate section connecting the distal end and the anchoring end. The distal end is disposed at the outer walls of the first and second panels and the anchoring end is disposed at the inner walls of the first and second panels.

In yet another aspect of the invention, an edge of the first panel has a male contour and an edge of the second panel has a congruent female contour such that the male contour can mate with the female contour at the joint. The intermediate section is similarly contoured to mate with adjoining edges of the first and second panels.

In still another aspect of the invention, an apparatus comprises a first panel having an inner and an outer wall, a second panel having an inner and an outer wall and joined to the first panel at a joint; means for interlocking the panels at the joint; and a support including a distal end, an anchoring end, and an intermediate section connecting the distal end and the anchoring end. The distal end is disposed at the outer walls of the first and second panels and the anchoring end is disposed at the inner walls of the first and second panels.

BRIEF DESCRIPTION OF THE DRAWINGS

FIG. 4 is a partial cross-sectional view of the support shown in FIG. 1 disposed between two interlocked panels of an insulating unit or walk-in;

FIG. 6 is a cross-sectional view of the present invention adapted for use in a corner, which may be formed at the junction of a side wall panel and ceiling panel of a walk-in;

DETAILED DESCRIPTION OF THE INVENTION

Figure 1:
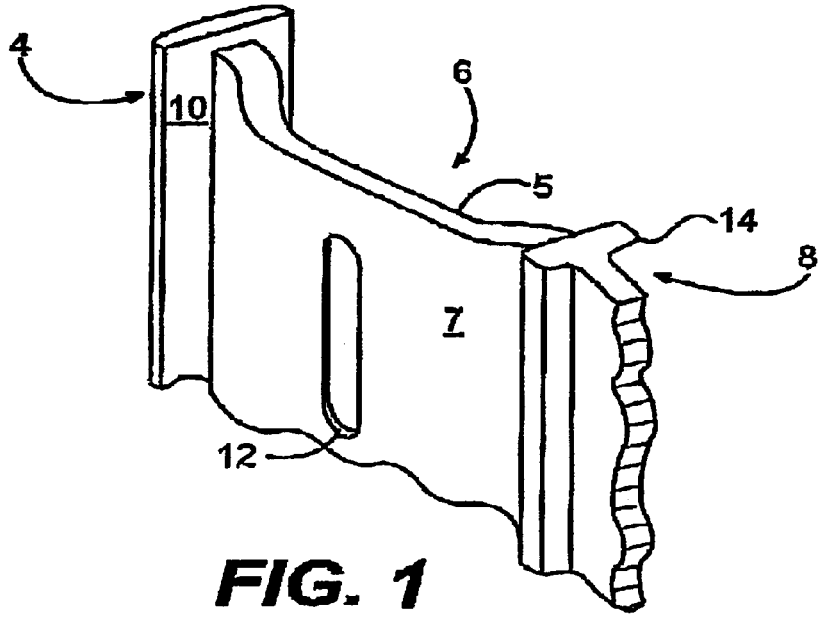
FIG. 1 is a partial perspective view of a support according to a preferred embodiment of the present invention.
Figure 7:
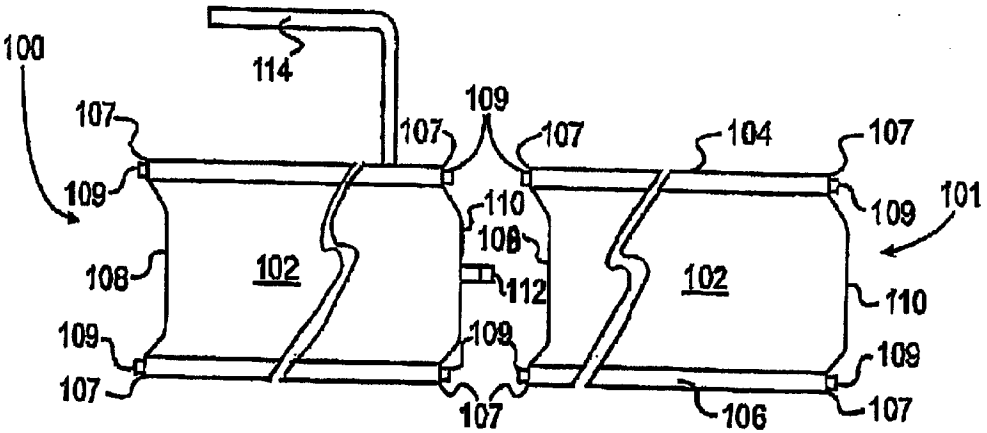
FIG. 7 PRIOR ART
FIG. 7 is a partial plan view of two prior art panels of an insulating unit.
Figure 8:
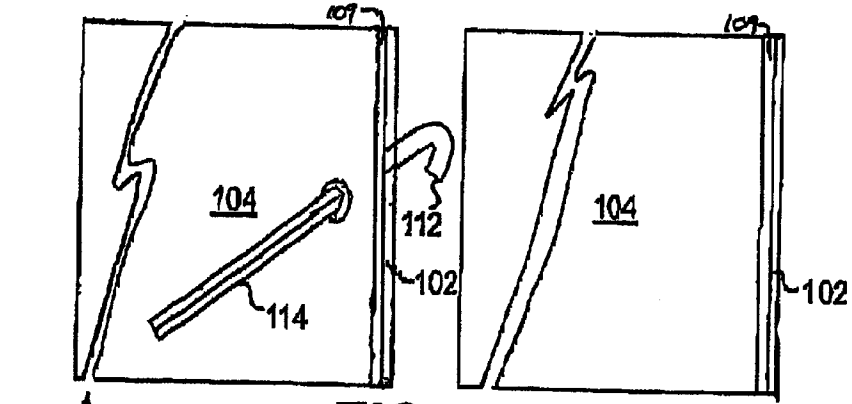
FIG. 8 PRIOR ART
FIG. 8 is a partial side elevation view of the two panels of the insulating unit shown in FIG. 7.
Figure 9:
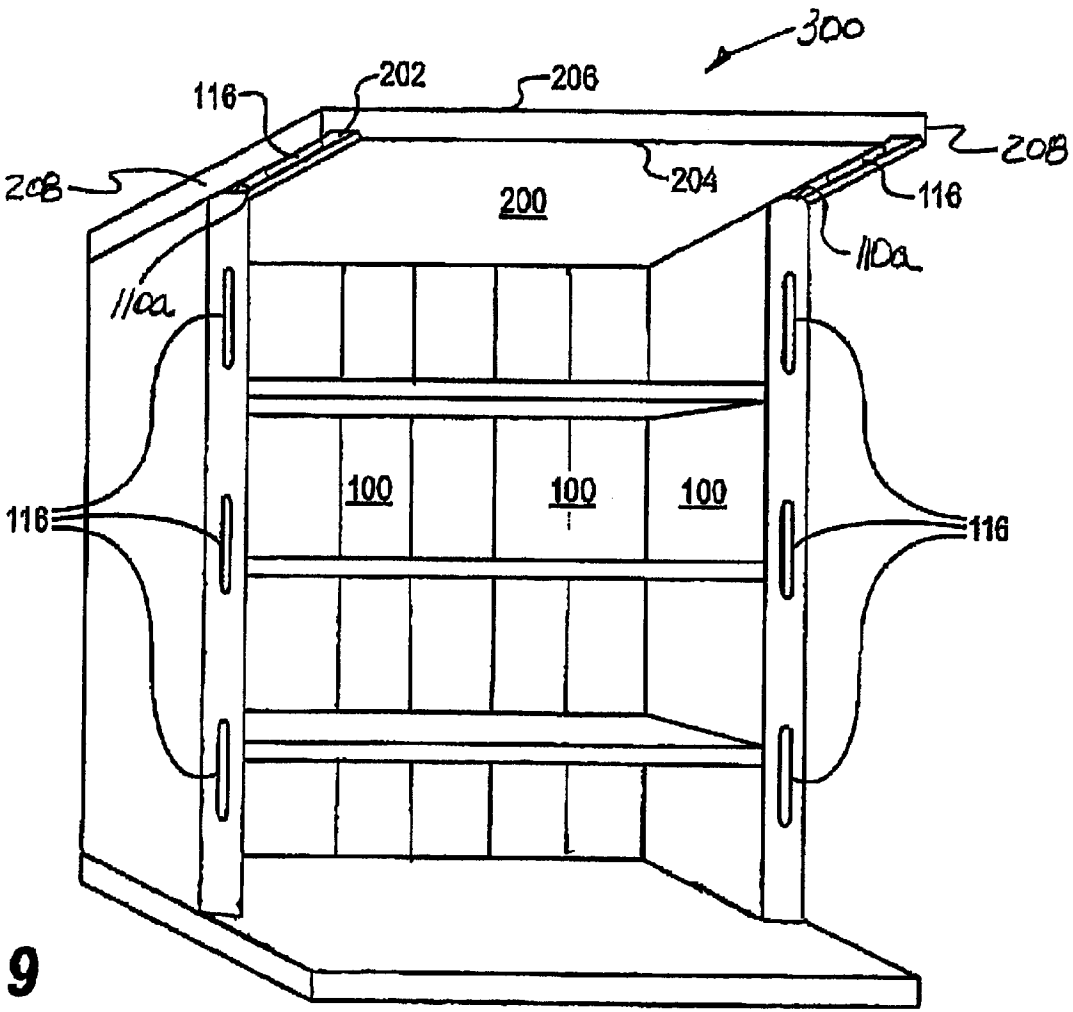
FIG. 9 is a perspective view of a partially-assembled insulating unit.

A support 1 in accordance with a preferred embodiment of the present invention is shown in FIG. 1 to include a distal end 4, an intermediate section 6 and an anchoring end 8. The intermediate section 6 is shaped to be congruent with or match the contour of the edges of the panels described above with reference to FIGS. 7 and 8 so as to fit within the joint of the interlocked panels. An elongated aperture 12 is provided to allow the pawl 112, comprising each panel interlocking mechanism, and catch to engage in the conventional manner described above. When the support 1 is installed, the distal end 4 and the anchoring end 8 are disposed on opposite sides of the panel 100.

The distal end 4 preferably includes a flange 10. The flange 10 prevents the support 1 from slipping into the joint toward the interior of the walk-in when the support and any mounted shelves are loaded. The flange also stiffens the support 1 and distributes load along the outer sidewall 106 of the panel. As shown in FIG. 1, the flange 10 preferably extends the entire length of the support 1. Nevertheless, one of ordinary skill will recognize that the flange 10 may extend less than the entire length of the support, or it may be comprised of discrete members protruding at discrete locations.

Figure 4:
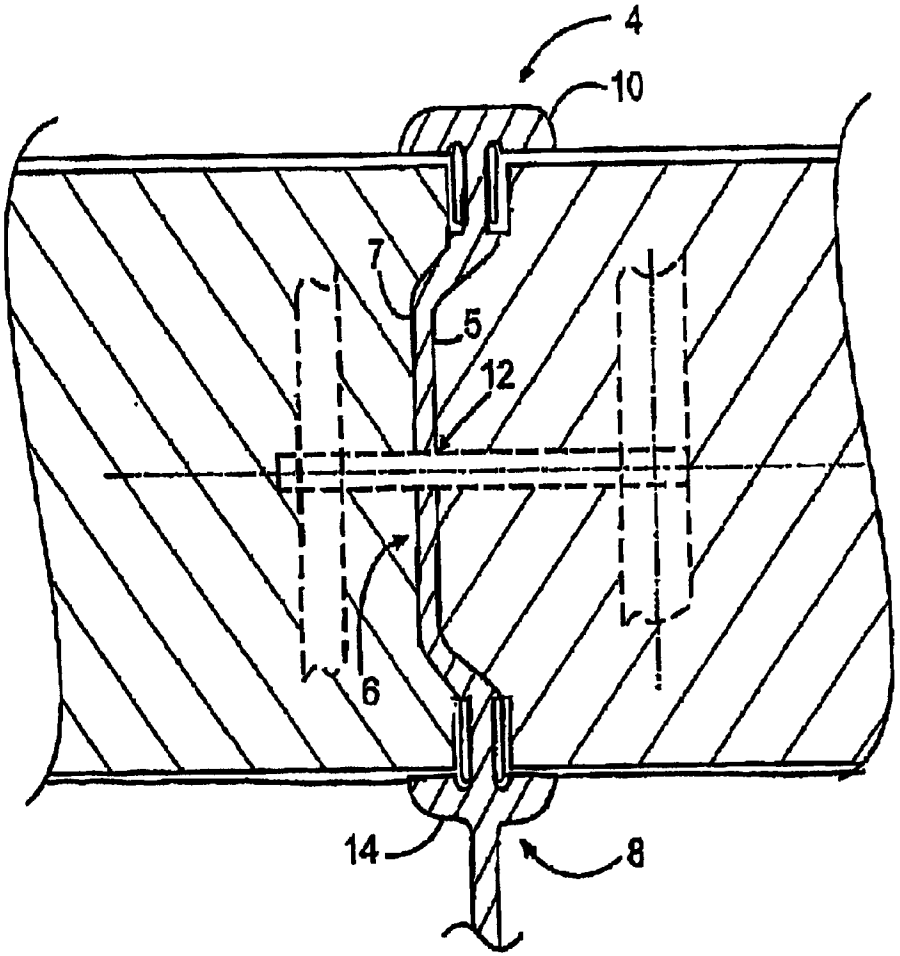

The intermediate section 6 has two sides 5, 7 and, as described above, has a horizontal cross-sectional shape to fit, or be congruent, with the contour of the mating edges 108, 110, of the panels as shown in FIG. 4. The contour illustrated is generally C- or U-shaped, but other shapes will not depart from the scope of the invention. An important aspect of the invention is the ability of the support 1 to fit between any two interlocking panels without disrupting the way in which the panels are interlocked or compromising the insulating properties of the panels. Accordingly, while the contour of the intermediate section 6 can vary, it is generally chosen to match the contour of the panel edges.

The flange 10 on the support may be omitted if the contour of the intermediate section 6 and the mating edges of the panels have sufficient relief to prevent the support from pulling through the panels when mounted shelving is loaded.

Figure 2:
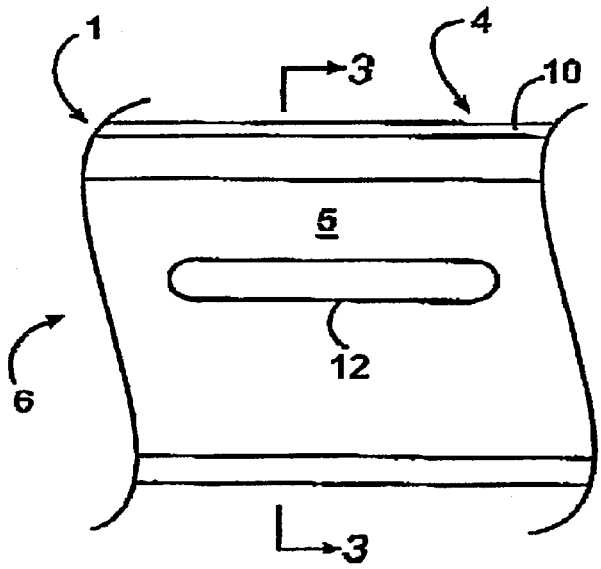
FIG. 2 is a partial side elevation of the support shown in FIG. 1.
Figure 3:
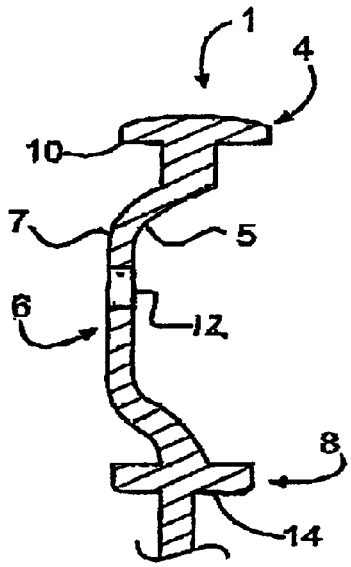
FIG. 3 is a partial cross-sectional view of the support taken along plane 3—3 in FIG. 2.

As shown in FIGS. 1 and 2, the elongated aperture 12 is provided to allow the pawl 112, comprising the interlocking mechanism in one wall panel 100, to pass through the support 1 and engage the catch in the adjacent wall panel 101. The size and shape of the aperture 12 can vary without affecting the nature of the invention, provided the aperture 12 is sufficiently large to allow the pawl 112 to move when actuated without hindrance.

The anchoring end 8 of the support 1 may also include a flange 14 to help distribute the load on the inner sidewall 104. Although the flange 14 shown is continuous, the flange 14 on the anchoring end 8 may be embodied by a variety of structures as previously mentioned with regard to the flange 10 on the distal end 4. Similarly, the flange 14 on the anchoring end of the support 1 can be omitted if sufficient structural support is otherwise provided by the remaining elements of the apparatus.

Figure 5A:
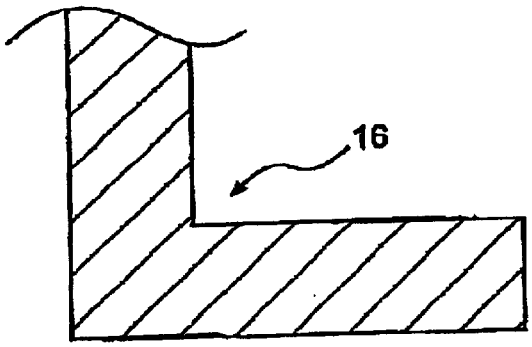
FIGS. 5A to 5C are partial cross-sectional views of alternative anchors adapted for use with the support of FIG. 1.
Figure 5B:
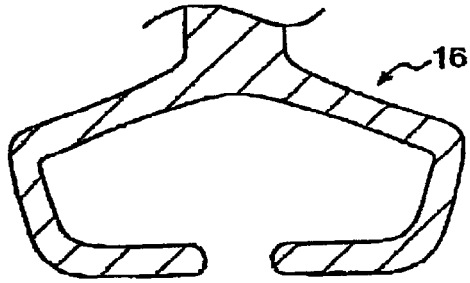
Figure 5C:
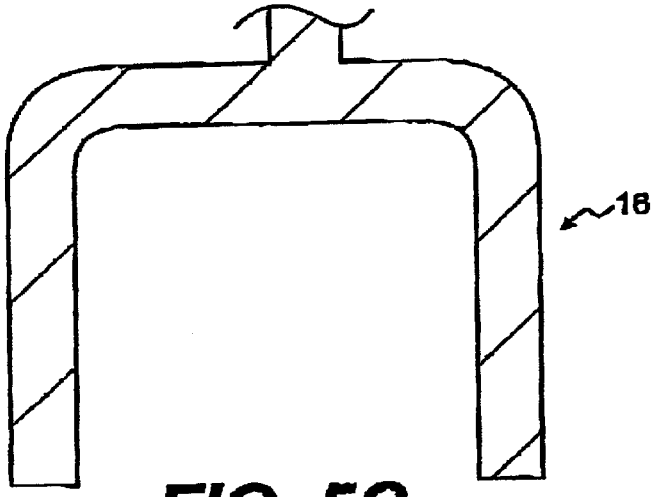

The anchoring end 8 also is integrally formed or otherwise provided with an anchor 16 for receiving a shelf directly or for receiving a shelf-mounting bracket. The particular shape of the anchor can vary and three possible alternative shapes are shown in FIGS. 5A to 5C. U.S. Pat. No. 5,645,257 shows an example of an anchor 16 coupled to a bracket, which is in turn attached to a shelf. These anchors 16 and the shelving systems to be used with them are disclosed in U.S. Pat. Nos. 5,645,257 and 5,592,886. (The disclosures of these and each of the other patents mentioned herein are incorporated herein by reference.) One of ordinary skill will also appreciate that the anchor 16 may be a continuous member extending the length of the support 1 as shown in FIGS. 5A to 5C, or a plurality of discrete members protruding from the anchoring end 8 at specific locations. Other alternative structures are also within the skill in art.

It will be appreciated that the support 1 may be a unitary member that extends between the floor and ceiling of the walk-in. Alternatively, the support may comprise discreet stacked sections of, for example, standard length that when so stacked extend between the floor and ceiling of the walk-in. In this way, the support 1 can hold substantial vertical load. In addition it will substantially completely fill the space between adjacent panels when assembled. The seals 109 on lips 107 of the outer and inner sidewalls of each panel will also mate with the sides of the support. Therefore, the insulating and moisture barrier properties of the walk-in are not compromised.

Moreover, the structure and configuration of the support, in combination with the structural properties of the joined adjacent panels, provide a substantial bending moment that permit cantilevered shelving mounted on the support to hold significant load.

Figure 6:
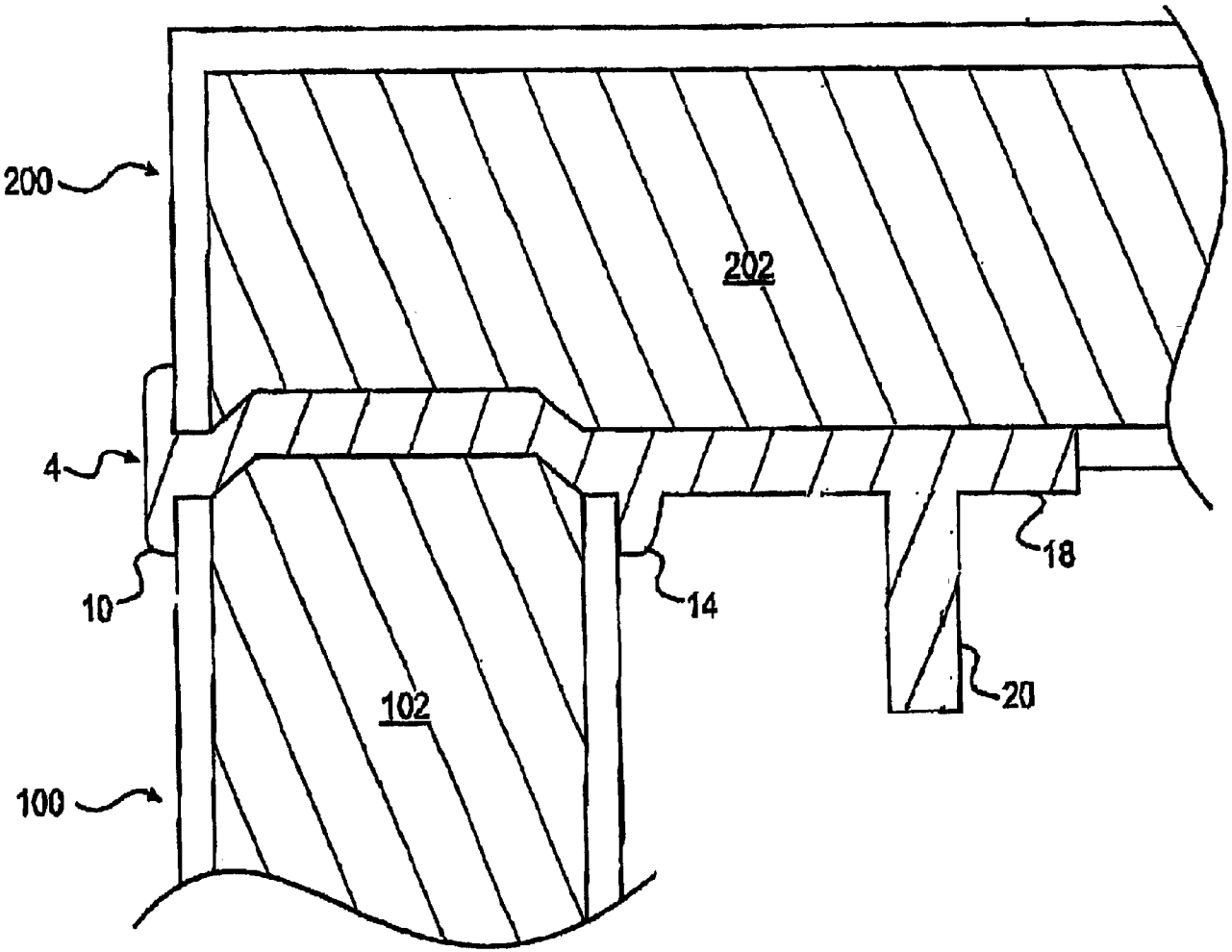

In a modification shown in FIG. 6, the support 1 is adapted to fit into a joint between a wall panel 100 and a ceiling panel 200. In such an embodiment, if utilized the flange 14 is trimmed on one side so that it will not interfere with the mating of the wall panel 100 and the ceiling panel 200. In addition, rather than an anchor 16 adapted to support a bracket or a shelf, a plate 18 is provided which runs parallel to the ceiling panel 200. The plate 18 has a securing means for securing a standard, shown as a depending vertical restraining wall 20. A standard is a vertical post to which a shelf is fastened, either directly or by way of a bracket. U.S. Pat. Nos. 5,592,886 and 5,645,257 show a bracket attached to such a standard. Of course, other types of anchors or plates can be provided without departing from the scope of the invention.

The securing means on the plate for holding a standard may include any of the following non-limiting examples: an anchor, a snap-in member having a spring-loaded button which engages an aperture in the standard or shelf, a threaded hole for receiving a screw or bolt, and a hook for engaging an aperture in the standard or shelf. Other securing means are possible, as one of ordinary skill will appreciate.

In a further modification, a support 1 as shown in FIG. 6 can also be fitted between a joint of two wall panels 100 connected at a corner. Of course, the type of anchor would change to accommodate the vertical orientation of the support 1, and could include the shapes shown in FIGS. 5A to 5C but adapted to fit in a corner.

The support 1 is preferably integrally formed of fiber-reinforced thermoset polyester. Fiber-reinforced thermoset polyester is preferred for its low heat transfer, or heat-insulating, properties and strength. Of course, the support 1 may also be formed of other plastics with or without reinforcing fibers, wood, graphite, ceramic, mixtures of one or more of the foregoing, or other materials one of ordinary skill finds suitable to the application. In addition, if reinforcing fibers are used, known fibrous materials such as glass or polymeric compositions are suitable.

The preferred fiber-reinforced thermoset polyester support 1 can be formed by a compression molding or a pultrusion process. The compression molding process is preferable because it results in a more random distribution of the reinforcing fibers than the pultrusion process. The pultrusion process, in contrast, tends to align the fibers along the length of the support 1.

While the present invention has been described with respect to what is presently considered to be the preferred embodiments, the present invention is not limited to the disclosed embodiments. Rather, the present invention covers various modifications and equivalent arrangements included within the spirit and scope of the appended claims. The scope of the appended claims is to be accorded the broadest interpretation so as to encompass all such modifications and equivalent structures and functions.

What is claimed is:

1. A support adapted for use between first and second panels at a joint, said support comprising:

a distal end;

an anchoring end, said anchoring end including an anchor adapted to receive and support at least one of a shelf and a shelf mounting bracket; and an intermediate section connecting said distal end and said anchoring end, said intermediate section receiving adjoining edges of the first and second panels when in use.

2. A support according to claim 1, wherein said support is formed of a heat-insulating material.

3. A support according to claim 2, wherein said heat-insulating material is fiber-reinforced polyester.

4. A support according to claim 1, wherein said first and second panels are secured together with at least one pawl, and wherein said intermediate section includes an aperture for allowing said pawl to pass through said support.

5. A support according to claim 1, further comprising a flange formed with said distal end.

6. A support according to claim 1, further comprising a flange formed with said anchoring end.

7. An apparatus comprising:

a first panel having an inner and an outer wall;

a second panel having an inner and an outer wall and joined to said first panel at a joint; and a support secured between said first and second panels at the joint, said support including a distal end, an anchoring end and an intermediate section connecting said distal end and said anchoring end, wherein said distal end is disposed in the region of said outer walls of said first and second panels and said anchoring end is disposed in the region of said inner walls of said first and second panels, and said anchoring end includes an anchor adapted to receive and support at least one of a shelf and a shelf mounting bracket.

8. A support according to claim 7, wherein said first panel has an edge having a male contour and said second panel has an edge having a female contour such that the male contour mates with the female contour at the joint, and said intermediate section is shaped to mate with adjoining edges of said first and second panels.

9. An apparatus according to claim 7, wherein said support is comprised of a heat-insulating material.

10. An apparatus according to claim 9, wherein said heat-insulating material is fiber-reinforced polyester.

11. An apparatus according to claim 7, wherein said support extends along the entire length of the joint.

12. An apparatus according to claim 7, wherein said first panel is a wall panel and said second panel is a ceiling panel, said wall panel and said ceiling panel interlocking at a horizontal joint, and wherein said support is disposed in the horizontal joint.

13. An apparatus according to claim 7, wherein said apparatus further comprises a pawl for interlocking said first and said second panels, and wherein said intermediate section includes an aperture through which said pawl may pass.

14. An apparatus according to claim 7, wherein said first and second panels include an insulating core having the inner wall on one side and the outer wall on another side opposite the one side.

15. An apparatus according to claim 7, further comprising a flange formed with said distant end of said support.

16. An apparatus according to claim 7, further comprising a flange formed with said anchoring end of said support.

17. An apparatus comprising:

a first panel having an inner and an outer wall;

a second panel having an inner and an outer wall and joined to said first panel at a joint;

means for interlocking said panels at the joint; and a support including a distal end, an anchoring end, and an intermediate section connecting said distal end and said anchoring end, wherein said distal end is disposed in the region of said outer walls of said first and second panels and said anchoring end is disposed in the region of said inner walls of said first and second panels, and said anchoring end includes an anchor adapted to receive and support at least one of a shelf and a shelf mounting bracket.

18. A support according to claim 17, wherein an edge of said first panel has a male contour and an edge of said second panel has a female contour such that the male contour mates with the female contour at the joint, and said intermediate section is contoured to mate with adjoining edges of said first and second panels.

19. An apparatus according to claim 17, wherein said support is comprised of a heat-insulating material.

20. An apparatus according to claim 17, wherein said heat-insulating material is fiber-reinforced polyester.

21. An apparatus according to claim 17, wherein said support extends along the entire length of the joint.

22. An apparatus according to claim 17, wherein said first panel is a wall panel and said second panel is a ceiling panel, said wall panel and said ceiling panel interlocking at a horizontal joint, and said support is disposed in the horizontal joint.

23. An apparatus according to claim 17, wherein said apparatus further comprises a pawl for interlocking said panels, and wherein said intermediate section includes an aperture through which said pawl may pass.

24. An apparatus according to claim 17, wherein said first and second panels include an insulating core having the inner wall on one side and the outer wall on another side opposite the one side.

25. An apparatus according to claim 17, further comprising a flange formed with said distal end of said support.

26. An apparatus according to claim 17, further comprising a flange formed with said anchoring end of said support.

* * * * *

UNITED STATES PATENT AND TRADEMARK OFFICE

CERTIFICATE OF CORRECTION

PATENT NO. : 6,918,341 B1
DATED : July 19, 2005
INVENTOR(S) : John H. Welsch et al.

It is certified that error appears in the above-identified patent and that said Letters Patent is hereby corrected as shown below:

Column 5,
Line 17, "utilized" should read -- utilized, --; and
Line 62, "is" should read -- are --.

Column 6,
Line 42, "A support" should read -- An apparatus --.

Column 7,
Line 21, "A support" should read -- An apparatus --.

Signed and Sealed this

Sixth Day of June, 2006

JON W. DUDAS
*Director of the United States Patent and Trademark Office*